United States Patent [19]

Adaci et al.

[11] Patent Number: 4,806,172

[45] Date of Patent: Feb. 21, 1989

[54] METHOD AND APPARATUS FOR REMOVING SUBSTANCES ADHERING TO SURFACE

[75] Inventors: Takayuki Adaci; Nobuo Nakano, both of Tokyo, Japan

[73] Assignees: JSE Corporation, Tokyo, Japan; Katsuhiko Watanabe Holdings Ltd., Calgary, Canada

[21] Appl. No.: 752,206

[22] Filed: Jul. 3, 1985

[30] Foreign Application Priority Data

Apr. 2, 1985 [JP] Japan ..... 60-70561

[51] Int. Cl.[4] ..... B08B 3/00

[52] U.S. Cl. ..... 134/34; 134/167 R; 122/390; 122/391; 15/316 A; 15/316 R; 239/DIG. 19; 239/550; 239/589; 239/590

[58] Field of Search ..... 134/10, 22.18, 21, 24, 134/34, 16, 167 R, 169 R; 122/390, 391, 38, 392, 382; 15/316 A, 316 R, 415 R, 302, 320; 239/DIG. 19, 589, 550, 600, 553.5, 590.3, 558

[56] References Cited

U.S. PATENT DOCUMENTS

| | | | |
|---|---|---|---|
| 1,919,027 | 7/1933 | Klotzman | 239/DIG. 19 |
| 3,709,436 | 1/1973 | Foster | 239/550 |
| 4,184,638 | 1/1980 | Ogasawara et al. | 239/589 |
| 4,307,840 | 12/1981 | Schulz et al. | 239/DIG. 19 |
| 4,424,769 | 1/1984 | Charomathieu et al. | 122/392 |
| 4,452,183 | 6/1984 | Yazidjian | 122/392 |

*Primary Examiner*—H. M. S. Sneed
*Assistant Examiner*—Sharon T. Cohon
*Attorney, Agent, or Firm*—Flynn, Thiel, Boutell & Tanis

[57] ABSTRACT

A method for removing substances adhering to a surface such as a wall of buildings in which a nozzle head having a plurality of nozzles is rotated eccentrically and moved sidewardly when used. The diameter of each of the nozzles is selected so as to be within a range of 0.05 to 0.5 mm, the pressure to be supplied to the nozzles is 800 kg/cm$^2$ or more, the total amount of water jetted from each of the nozzles is 12 l/min or less and the number of revolutions of the nozzle head is 800 to 4000 rpm.

5 Claims, 4 Drawing Sheets

METHOD AND APPARATUS FOR REMOVING SUBSTANCES ADHERING TO SURFACE

BACKGROUND OF THE INVENTION

1. Field of the Invention

This invention relates to a method and apparatus for removing substances adhering to a surface, and more particurlarly to a method and apparatus for washing and stripping an outer surface of buildings or the like including substances adhering to the surface.

2. Prior Art

The external wall of a building gets dirty or contaminated by dust contained in air or rain with the passage of time. In general, the wall is needs to be renovated, for example by re-painting, every ten years or so. In case of a special kind of wall such as a so-called curtain wall, the wall should be washed every two or three years to remove dirt thereon. Or, as the case may be, there is a need for stripping a coating on the wall to expose a surface thereof.

Washing of the wall is generally carried out by using water or washing chemicals. When water is used, relatively high-pressure water of a pressure of about 40 to 200 kg/cm$^2$ is jetted through a nozzle having a diameter of about 2mm at a flow rate of 25 to 45 1/min.

Stripping or peeling of the coating of the wall is carried out by using a sander, a chip-cleaner or a concrete-planer. Alternatively, chemicals are also used for stripping or peeling.

However, these conventional methods have various disadvantages. When chemicals are used in washing, there is no problem of dusting, but the chemicals usually contain acids and they give undesirable influence upon plants on the ground and possibly deteriorate or change the properties of the surface of the wall.

Sanding or planing can effectively remove dirt or contaminant on the wall together with a surface thereof, but it has such a fatal defect that it makes a dust, compromising the safety of the operator and contaminating the surroundings. If water is used in sanding or planing to prevent dusting the sander or planer will be clogged and the operation efficiency will be lowered.

In contrast, the method using high-pressure water is free from the problems as described above and it is advantageous in that water can be easily obtained at a low cost. However, the conventional method of this type is not satisfactory in that water is only jetted from a single nozzle and therefore washing or stripping is only made linearly when the nozzle is moved. Thus, the operation efficiency is extremely low.

SUMMARY OF THE INVENTION

It is therefore an object of the present invention to provide a method and apparatus for removing substances adhering to a surface which is excellent in operation efficiency and free from dusting which assures the safety of the operator.

In accordance with the present invention, there is provided a method for removing substances adhering on a surface, which is characterized in that a nozzle head with plurality of unit nozzles opening on the front face thereof and disposed at different positions thereon is held by a holder in such a manner that it may continuously revolve around a center which is deviated from an axis of the nozzle head, the nozzle head is moved substantially in parallel with the surface to be treated while jetting high-pressure water from the nozzles onto the surface, the diameter of each of the nozzles is selected to be 0.05 to 0.5 mm, the water pressure to be supplied to each of the nozzles is 800 kg/cm$^2$ or more, the total amount of water jetted from each of the nozzles is 12 l/min or less and the number of revolutions of the nozzle head is 800 to 4000 rpm.

The present invention may be applied to washing of an outer wall of buildings or the like for removal of dirt or contaminant, stripping or peeling of coatings such as paints, removing of deteriorated sprayed tiles, removing of concrete dust or removing of scale or rust of steel plates. The invention may further be applied to removal of burr on an inner wall of a tank.

DESCRIPTION OF PREFERRED EMBODIMENT

Figure 1:
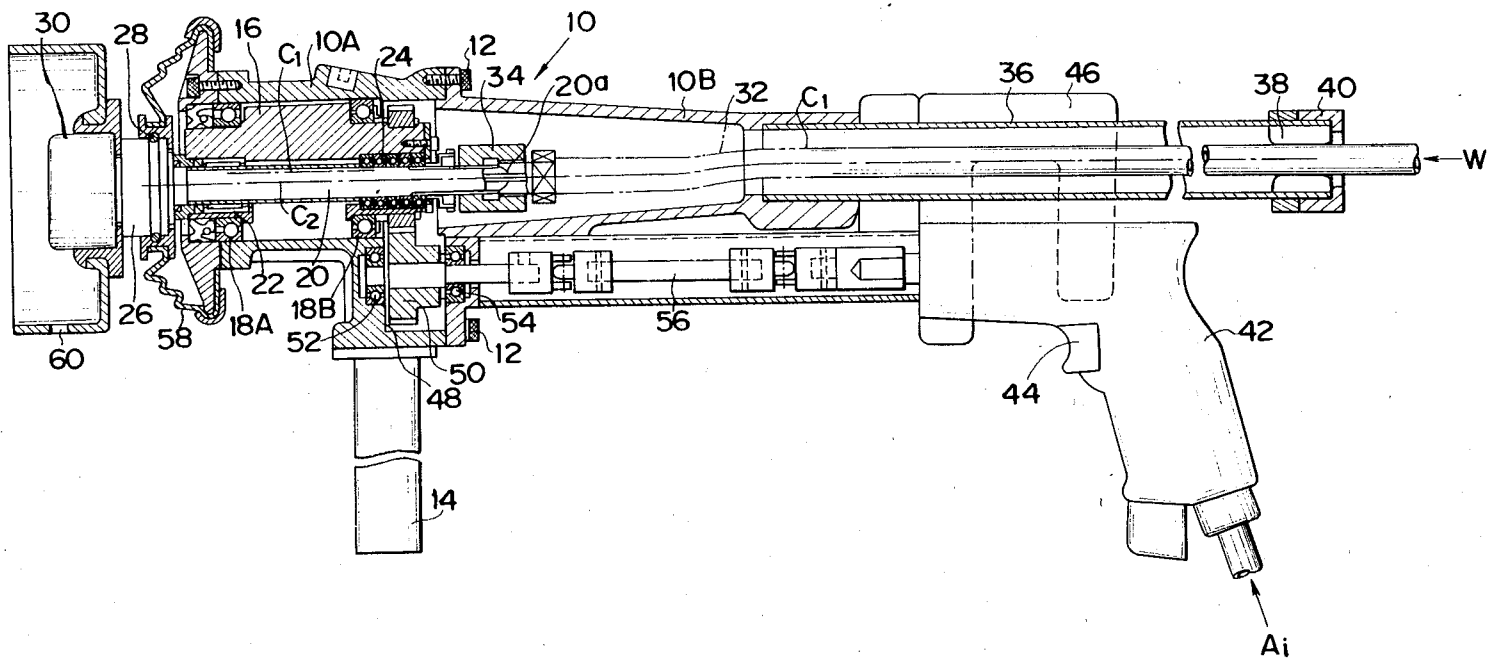
FIG. 1 is a longitudinal sectional view of an apparatus embodying the present invention.

The invention will be described in detail referring to the drawings.

The structure of an apparatus embodying the present invention will be first described.

10 is a holder which is substantially cylindrical. The holder 10 comprises a front portion 10A and a rear portion 10B which are coupled by bolts 12 in a position for use but they are disengageable from each other according to necessity, for example, when the holder is required to be repaired. The front portion 10A has a handle 14 provided integrally therewith at a lower portion thereof. Within the front portion 10A, a revolving follower gear 16 is supported by bearings 18A and 18B and adapted to be rotated around its axis C1. The revolving follower gear 16 is provided with a liquid feed pipe 20 having an axis C2 at a position offset for example by 5 mm from the axis Cl of the holder 10 and the liquid feeding pipe 20 is supported by bearings 22 and 24. An attachment 26 is integrally secured to the forward end of the liquid feeding pipe 20 through a thrust bearing 28. A nozzle head 30 as will be described in detail later is connected integrally with the attachment 26 in such a manner that its axis may be aligned with the axis C2.

The rear end of the liquid feeding pipe 20 is coupled through a semi-spherical seat **20*a* to a flexible tube 32 which is in turn connected to an external pump (not shown) for high-pressure water W. 34 is a holding member for holding the coupling portion. The rear end of the flexible tube 32 is fixed in a protection pipe 36 mounted on the rear portion 10B of the holder 10 through a bush 38 and a securing nut 40**.

42 is an air motor driven by air Ai. The air motor is adapted to be held by a right hand of an operator and cooperates with the handle 14 to be held by a left hand of the operator to support the entire structure of the holder 10. The air motor 42 includes a switch 44 and it is coupled to the protection pipe 36 by a mounting bracket 46. There remains a space 48 between the front portion 10A and the rear portion 10B of the holder 10. Within the space 48 is rotatably supported a prime gear 50 by bearings 52 and 54. The output shaft of the air motor 42 and the prime gear 50 are coupled by a connecting rod 56 and the prime gear 50 is in mesh with the follower gear 16.

The front end of the holder 10 is protected by a flexible cover 58 made of a flexible material such as rubber for preventing rebound of dust from the surface being treated. The nozzle head 30 is also protected by a cover 60.

Figure 5:
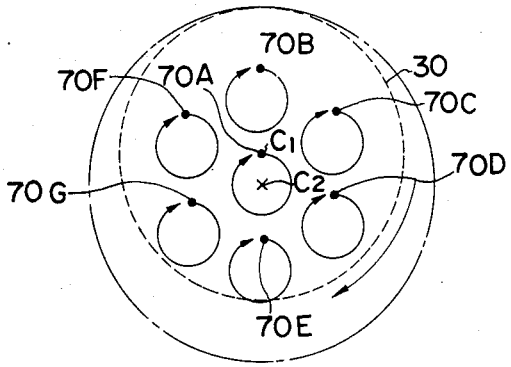
FIG. 5 shows loci of nozzles when the nozzle head is held at a position.

With this arrangement, when high-pressure water W is fed to the flexible tube 32 through the pump, the water W passes through the liquid feeding pipe 20 to the nozzle head 30 through which water is jetted onto the surface to be treated. At this time, the air motor 42 is rotated and the follower gear 16 is rotated through the prime gear 50. Since the follower gear 16 has the liquid feeding pipe 20 at a position offset from the axis Cl of the holder 10, the nozzle head 30 is revolved around the axis Cl as illustrated in FIG.5. The forward portion of the flexible shaft 32 is revolved following the revolution of the nozzle head 30. The shaking of the nozzle head caused at this time is absorbed by the bearings 22 and 24.

Figure 2:
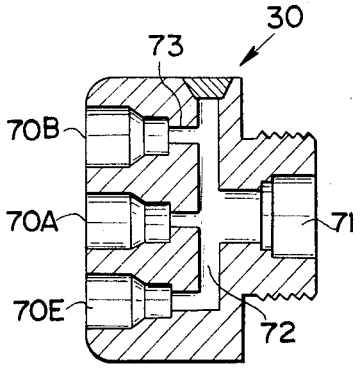
FIG. 2 is a sectional view of a nozzle head employable in the present invention.
Figure 3:
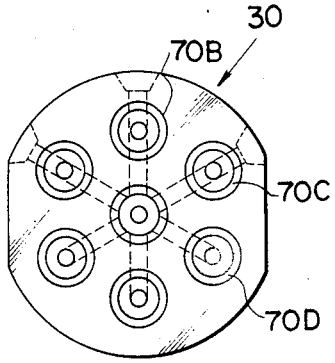
FIG. 3 is a left side elevational view of the nozzle head of FIG. 2.

According to the present invention, a plurality of nozzles 70A, 70B ..., for example, seven nozzles are provided on the nozzle head as illustrated in FIGS. 2 and 3. In the nozzle head as illustrated, one nozzle is at a center and the remaining six nozzles are disposed at angular intervals of 60 degrees so as to surround the center one. The nozzle head 30 has, at a central portion thereof, an inlet 71 communicating with the liquid feeding pipe 20, communicating passages 72 extending radially therefrom and introducing passages 73 communicating therewith. Thus, each of the nozzles 70A, 70B.... is communicated with the liquid feeding pipe 20 forming a liquid feeding path.

Figure 4:
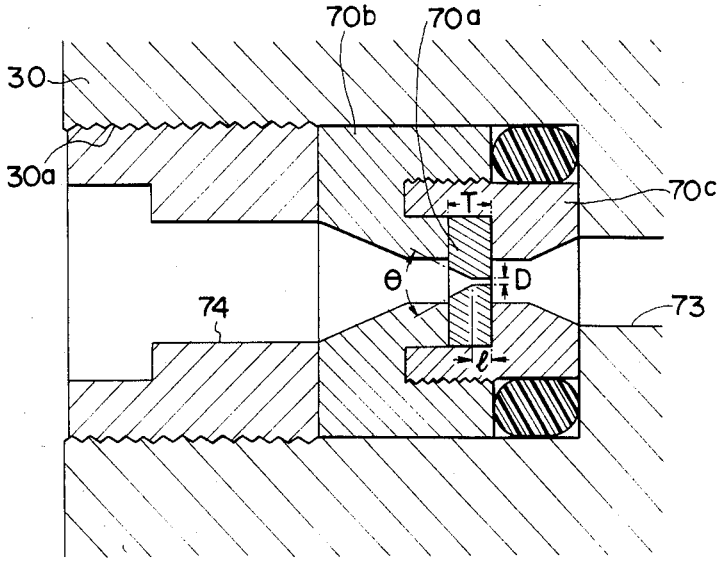
FIG. 4 is a detailed sectional view of a nozzle provided in the nozzle head.

The details of each of the nozzles are illustrated in FIG.4. For example, the nozzle comprises a nozzle tip **70*a* of diamond fitted in a hole 30*a* which is formed on the nozzle head 30 made of a titanium alloy. The nozzle tip 70*a* is held by holding pieces 70*b*, 70*c* made of a monel metal and fixed in a position by a nut 74** made of stainless steel and having a hexagonal hole.

The thickness T of the nozzle tip **70*a* is, for example, 0.5 to 2 mm and more preferably 0.5 to 1.5 mm and it has an opening having a reduced diameter portion where the diameter D is about 0.15 mm and a tapering portion where the opening has an angle $\theta$ of 25° to 55°, preferably 35° to 45°. The length l of the reduced diameter portion is preferably $\frac{1}{2}T \leqq l \leqq 2/3T$. In case the length l is larger than 2/3T, there may be caused turbulent flow and in case the length l is smaller than $\frac{1}{2}T$, the nozzle tip 70*a*** is liable to be worn out. When the angle $\theta$ of the opening is larger than 55°, water jetted through the nozzle is atomized and the energy of water per unit area is lowered. When the angle is smaller than 25°, not only water jetted through the nozzle becomes turbulent, but the operation efficiency is lowered.

Figure 6:
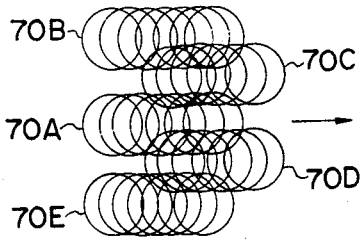
FIG. 6 shows loci of nozzles when the nozzle head is moved sidewardly.

In the present invention, the pressure of water fed to each of the nozzles 70A, 70B ... is above 800 kg/cm$^2$ and preferably 1000 kg/cm$^2$ or more. When high-pressure water is jetted from each of the nozzles while the nozzle head 30 is being revolved as illustrated in FIG.5, the loci of jetted water are as shown in FIG.5. In this state, when the nozzle head 30 is moved sidewardly, the loci ecome as illustrated in FIG.6. In the figure, the loci of the nozzles 70F and 70G are omitted. Thus, the high-pressure water acts all over the surface to be treated and washing and peeling of the substances adhering thereto may be attained over a wide area.

Figure 7:
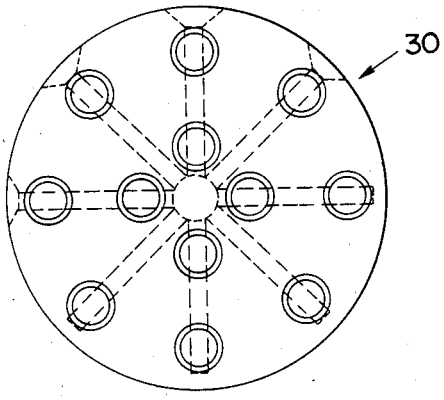
FIGS. 7 and 8 are front side elevational views of alternative nozzle heads, respectively.
Figure 8:
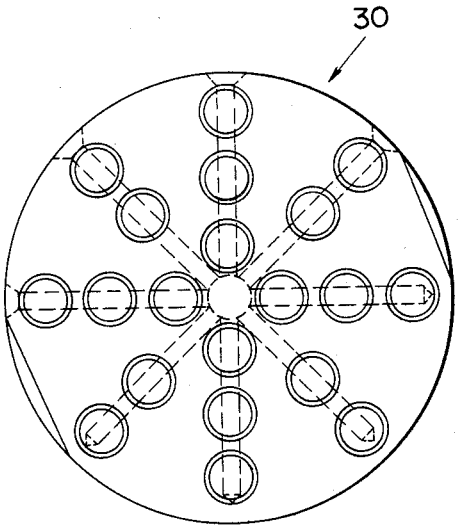

The number of the nozzles on the nozzle head is not critical and it may be selected according to necessity. It may, for example, be seven as illustrated in FIG.3, twelve as illustrated in FIG.7 and twenty as illustrated in FIG.8. However, the positions of the nozzles may be selected in relation with the distance of the deviation so that the locus of each of the nozzles may overlap as illustrated in FIG.6.

The diameter D of the nozzles, the pressure P of water, the amount q of jet flow per nozzle, the amount Q of total jet flow and the number R of revolutions of the nozzle head are selected so as to be within the following ranges. The optimum ranges are denoted within the parentheses.

$D = 0.05$ to 0.5 mm (0.1 to 0.3 mm)

Figure 9:
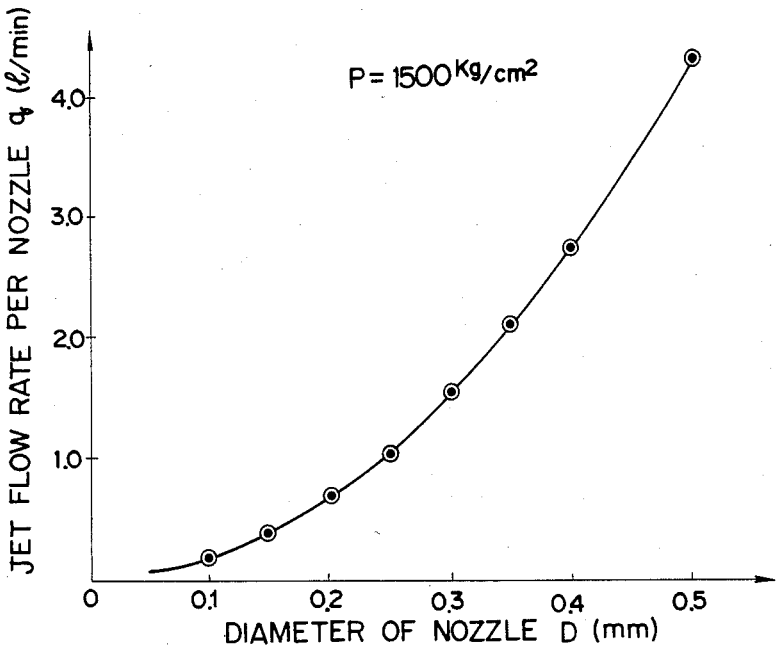
FIGS. 9 and 10 are graphs showing the relationships between the nozzle diameter and the flow rate.
Figure 10:
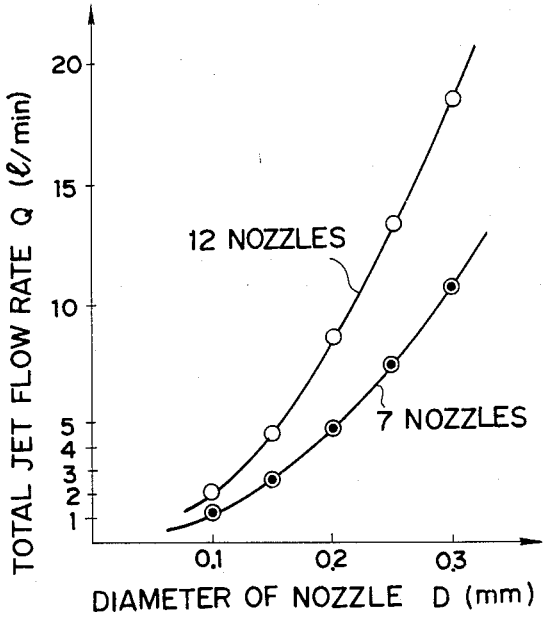

$0.1\ l/\text{min}\ (0.2) \leqq q \leqq 4.3\ l/\text{min}\ (3.0)$ $1.5\ l/\text{min}\ (2.0) \leqq Q \leqq 12\ l/\text{min}\ (8.0)$ $800\ \text{kg/cm}^2\ (1000) \leqq P \leqq 5000\ \text{kg/cm}^2\ (3000)$ $800\ \text{rpm}\ (1000) \leqq R \leqq 4000\ \text{rpm}\ (2500)$ The diameter D of the nozzle, the jet flow q per nozzle and the total jet flow Q have relationships as shown in FIGS. 9 and 10. In case the nozzle diameter D is smaller than the specified limit, the jet energy is too small to obtain sufficient washing and peeling effects even if the pressure of water is raised. In addition, clogging may possibly be caused at a nozzle, especially at a nozzle tip. In case the diameter D is larger than the specified limit, the flow q and Q become too large for an operator to hold the apparatus by hand and too large to drain without a draining system. In case the pressure P is small, the washing and peeling effects are insufficient and in case the pressure P is large, desired washing and peeling effects can be obtained. However, in the latter case, there are such disadvantages that the wearing of the nozzle tip is large and therefore the material of the nozzle tip should be selected so as to have sufficient strength to tolerate the wearing. If the number R of revolutions is small, each of the nozzles stays in one position too long, which results in harming the surface and lowering of operation efficiency. Whereas, if the number R of the revolutions is too large, the strength of the member for eccentrically holding the water feeding pipe cannot be assured.

However, if Q or P is raised, the reacting force caused by jetting of water onto the surface to be treated acts on the holder 10. When the nozzle head has seven nozzles each having a diameter D=0.2 mm, Q is about 5 l and the reaction force is about 9.5 kg. The weight of the apparatus is about 5 kg. In this connection, it is to be noted that the weight including the reaction which the operator can hold safely is about 15 kg. Thus, there is a limit in weight which the operator can support with safety and therefore the total weight should be considered. However, if the holder 10 is mounted on a machine or the holder itself is a part of the machine, the reaction may be larger.

As described above, according to the present invention, the nozzle head having a plurality of unit nozzles is revolved eccentrically, whereby washing or peeling can be effected over a wide area at a time as shown in FIG.6. This feature is different from the conventional technique in which washing or peeling is effected only linearly.

Another characteristic feature of the present invention lies in that a small amount of water is jetted at an extremely high pressure. In a conventional technique, a large amount of water is jetted through a nozzle of large diameter at a pressure of 40 to 200 kg/cm$^2$. However, the effect of washing, especially effect of peeling is rather small for the amount of water used. The consumption of large amount of water brings further disadvantages that the operation efficiency is lowered and that water drainage system is needed.

In contrast, according to the present invention, small amount of water is jetted at an extremely high pressure, so that the jet stream from each of the nozzles strongly taps the surface to be treated. Thus, large effect of washing and peeling can be obtained. Furthermore, plurality of such jet streams are provided from the nozzle head which is rotated at a rate as high as 800 to 4000 rpm. As a result, the washing and peeling effects can be easily spread all over the durface. Thus, operation efficiency can be improved.

We claim:

1. A method for removing substance adhering on a surface, utilizing an elongated holder having a central longitudinal axis, a front axial end and a rear axial end; a nozzle head mounted on said front axial end of said holder and extending frontwardly therefrom, said nozzle head having a central axis that is parallel with and laterally offset from said central longitudinal axis of said holder, means for continuously revolving said nozzle head about said central longitudinal axis of said holder, said nozzle head having a plurality of spaced-apart nozzles arranged in a pattern on the front face thereof so that said nozzles move through separat ®circular paths when said nozzl ®h ®ad revolves around said central longitudinal axis of said holder, said nozzles having an orifice diameter of from 0.05 to 0.5 mm, which comprises the steps of: continuously undirectional revolving said nozzle head around said central longitudinal axis of said holder at a rate of 800 to 4000 rpm, simultaneously moving said nozzle head substantially in parallel with said surface, simultaneously supplying water at a pressure of 800 kg/cm$^2$ or higher and at a volumetric flow rate of 12 liters/min or less to said nozzles and thereby jetting said high pressure water from said nozzles against said surface, the loci of the streams of said high pressure water jetted from said nozzles overlapping each other as said nozzle head is moved substantially in parallel with said surface.

2. A method according to claim 1, wherein the volumetric flow rate of water jetted from each of the nozzles is 0.1 to 4.3 liters/min.

3. A method according to claim 1, wherein the water pressure is 800 to 5000 kg/cm$^2$ and the volumetric flow rate of water jetted from the nozzles is 1.5 to 12 l/min.

4. A method according to claim 1 in which the diameter of each of the nozzles is from 0.1 to 0.3 mm, the volumetric flow rate of water jetted from each of the nozzles is from 0.2 to 3.0 liters/min, the total volumetric flow rate of water jetted from all of the nozzles is from 2.0 to 8.0 liters/min, the pressure of the water supplied to the nozzles is from 1000 to 3000 kg/cm$^2$ and the rate of revolutions of said nozzle head around said central longitudinal axis is from 1000 to 2500 rpm.

5. A method according to claim 1 wherein said means for continuously revolving said nozzle head comprises a gear mounted in said holder for rotation around said central longitudinal axis of said holder; and bearing means mounted in said gear concentric with said central axis of said nozzle head, said nozzle head being supported on said gear by said bearing means.

* * * * *

UNITED STATES PATENT AND TRADEMARK OFFICE

CERTIFICATE OF CORRECTION

PATENT NO. : 4 806 172

DATED : February 21, 1989

INVENTOR(S) : Takayuki ADACHI et al

It is certified that error appears in the above-identified patent and that said Letters Patent is hereby corrected as shown below:

On the title page, at item [75] change the surname of the first inventor to ---Adachi---.

Column 6, line 1; change "separat®circular" to ---separate circular---.

Column 6, line 2; change "nozzl®h®ad" to ---nozzle head---.

Signed and Sealed this

Seventeenth Day of October, 1989

*Attest:*

*Attesting Officer*

DONALD J. QUIGG

*Commissioner of Patents and Trademarks*